US011268284B2

(12) United States Patent
Ohrstrom

(10) Patent No.: US 11,268,284 B2
(45) Date of Patent: Mar. 8, 2022

(54) RAILING SYSTEM

(71) Applicant: VISION EXTRUSIONS GROUP LIMITED, Woodbridge (CA)

(72) Inventor: Rolf Ohrstrom, Woodbridge (CA)

(73) Assignee: Vision Extrusions Group Limited, Woodbridge (CA)

( * ) Notice: Subject to any disclaimer, the term of this patent is extended or adjusted under 35 U.S.C. 154(b) by 537 days.

(21) Appl. No.: 16/190,771

(22) Filed: Nov. 14, 2018

(65) Prior Publication Data

US 2019/0186153 A1 Jun. 20, 2019

Related U.S. Application Data

(60) Provisional application No. 62/586,088, filed on Nov. 14, 2017.

(51) Int. Cl.
*E04F 11/18* (2006.01)

(52) U.S. Cl.
CPC ... *E04F 11/1817* (2013.01); *E04F 2011/1821* (2013.01); *E04F 2011/1823* (2013.01); *E04F 2011/1827* (2013.01); *E04F 2011/1897* (2013.01)

(58) Field of Classification Search
CPC . E04F 11/181; E04F 11/1812; E04F 11/1817; E04F 11/1819; E04F 11/1821; E04F 11/1823; E04F 11/1825; E04F 11/1827; E04F 11/1829; E04H 17/14; E04H 17/1417; E04H 17/1426
See application file for complete search history.

(56) References Cited

U.S. PATENT DOCUMENTS

| | | | | |
|---|---|---|---|---|
| 1,114,486 A | | 10/1914 | Kimball | |
| 2,218,953 A | | 10/1940 | Gustafson | |
| 2,218,954 A | | 10/1940 | Gustafson | |
| 2,608,386 A | | 8/1952 | Hart | |
| 2,754,092 A | * | 7/1956 | Cremens | E04F 11/181 256/21 |
| 3,083,951 A | | 4/1963 | Huret | |

(Continued)

FOREIGN PATENT DOCUMENTS

| | | |
|---|---|---|
| CA | 1318164 | 5/1993 |
| CA | 2157325 A1 | 3/1997 |

(Continued)

OTHER PUBLICATIONS

Canadian Intellectual Property Office, Examiner's Requisition and Examination Search Report, Canadian Application No. 2,683,274 dated Dec. 2, 2015, 5 pages.

(Continued)

*Primary Examiner* — Jonathan P Masinick
(74) *Attorney, Agent, or Firm* — Ohlandt, Greeley, Ruggiero & Perle, L.L.P.

(57) ABSTRACT

A railing system comprising positioning systems is provided. The railing system includes one or more rails and one or more posts. When the rails and the posts are connected, the positioning systems limit the movement of the posts relative to the rails. The positioning system may include a projection on the rail and a recess on the post, and the projection and the recess cooperate such that the movement of the post relative to the rail is limited.

14 Claims, 8 Drawing Sheets

(56) References Cited

U.S. PATENT DOCUMENTS 3,113,760 A * 12/1963 Huret ..... E04F 11/181 256/59
3,136,530 A 6/1964 Case
3,164,354 A 1/1965 Murdock
3,289,381 A 12/1966 Blum et al.
3,339,895 A * 9/1967 Kusel ..... E04F 11/181 256/22
3,343,811 A * 9/1967 Kusel ..... E04F 11/181 256/22
3,385,567 A 5/1968 Case et al.
3,388,884 A 6/1968 Eggler et al.
3,398,981 A 8/1968 Vincens
3,403,641 A 10/1968 Baker
3,485,006 A 12/1969 DeRozario
3,490,797 A 1/1970 Platte
3,491,984 A 1/1970 Nyberg
3,498,589 A 3/1970 Murdock
3,506,243 A 4/1970 Seiler
3,610,427 A 10/1971 Maziarka et al.
3,617,077 A 11/1971 Cavanaugh, Sr.
3,618,993 A 11/1971 Platte
3,752,553 A 8/1973 Bildahl et al.
3,756,567 A 9/1973 Murdock
3,822,053 A 7/1974 Daily
3,918,686 A 11/1975 Knott et al.
3,931,946 A 1/1976 Soltysik
3,973,756 A 8/1976 Lauzier
4,007,919 A 2/1977 Totten
4,014,520 A 3/1977 Walters
4,035,978 A 7/1977 Bajorek et al.
4,050,828 A 9/1977 Noro
4,148,454 A 4/1979 Carlson et al.
4,189,796 A 2/1980 Gutner
4,266,757 A 5/1981 Kirkwood
4,340,199 A 7/1982 Brock
4,389,133 A 6/1983 Oberst
4,390,164 A 6/1983 Cokelekoglu
4,390,165 A 6/1983 Murlock
4,477,058 A 10/1984 Lowery
4,480,854 A 11/1984 Doty
4,565,465 A 1/1986 Oberst
4,585,214 A * 4/1986 Cope ..... E04F 11/181 256/65.09
4,586,697 A 5/1986 Tornya
4,623,128 A 11/1986 Dutch et al.
4,725,044 A 2/1988 Cluff
4,797,020 A 1/1989 Winston
4,805,879 A 2/1989 Spera
4,809,955 A 3/1989 Veilleux
4,883,256 A 11/1989 Hebda
4,919,394 A 4/1990 Otte et al.
4,929,116 A 5/1990 Mahl
4,976,567 A 12/1990 Spier
4,995,591 A 2/1991 Humphrey et al.
5,011,325 A 4/1991 Antonioli
5,247,773 A 9/1993 Weir
5,284,359 A 2/1994 Baba
5,454,548 A 10/1995 Moore
5,533,237 A 7/1996 Higgins
5,544,866 A 8/1996 Dye
5,660,378 A 8/1997 Schall
5,702,090 A 12/1997 Edgman
5,713,171 A 2/1998 Andres
5,836,714 A 11/1998 Christensen
5,862,642 A 1/1999 Erwin
5,882,001 A 3/1999 Reinbold
5,988,599 A 11/1999 Forbis
6,029,954 A 2/2000 Murdaca
6,042,296 A 3/2000 Wittig et al.
D427,322 S 6/2000 DeSouza
6,135,425 A 10/2000 Platt
6,173,944 B1 1/2001 McCarthy
6,202,987 B1 3/2001 Forbis
6,290,214 B1 9/2001 DeSouza
6,305,670 B1 10/2001 Ward et al.
6,311,955 B1 11/2001 McGarry
6,375,166 B1 4/2002 Schall
6,398,193 B1 6/2002 DeSouza
6,446,398 B2 9/2002 Weir
6,460,829 B1 10/2002 Forbis et al.
6,467,756 B1 10/2002 Elsasser
6,478,287 B2 11/2002 DeSouza
6,508,457 B1 1/2003 Knudson et al.
6,524,518 B1 2/2003 Pelfrey
6,595,497 B1 7/2003 Linford et al.
6,631,887 B1 10/2003 Walmsley
6,637,728 B2 10/2003 Pettit et al.
6,698,726 B2 3/2004 Platt
6,702,259 B2 3/2004 Pratt
6,719,278 B2 * 4/2004 Bryan ..... E04F 11/181 256/65.01
6,752,385 B2 6/2004 Zen et al.
6,752,386 B1 6/2004 Bundy
6,752,438 B2 6/2004 DeSouza
6,755,394 B2 6/2004 Forbis et al.
6,823,638 B2 11/2004 Stanchfield
6,874,766 B2 4/2005 Curatolo
6,932,328 B2 8/2005 Shreiner et al.
7,007,363 B2 3/2006 Forbis
7,021,607 B1 4/2006 Alexander
7,032,891 B2 4/2006 Rowley et al.
7,048,259 B2 5/2006 Quaintance et al.
7,152,849 B2 12/2006 Graber
7,168,689 B2 1/2007 Giralt
7,347,412 B1 3/2008 Zhu
7,360,754 B2 4/2008 Robbins
7,434,789 B2 10/2008 Crumrine
7,438,284 B2 * 10/2008 McGinness ..... E04F 11/1812 256/59
7,445,196 B2 11/2008 Cantley et al.
7,500,654 B2 3/2009 Rosaen
7,530,550 B2 5/2009 Fattori
7,543,802 B2 6/2009 Petta et al.
7,641,180 B2 1/2010 Adderton
7,654,401 B2 2/2010 Obergoenner
7,641,963 B2 4/2010 Grafenauer
7,744,065 B2 6/2010 Terrels et al.
7,789,376 B2 9/2010 Diamond et al.
7,802,351 B2 9/2010 McGinness et al.
7,857,291 B2 12/2010 Dombroski
D670,405 S 11/2012 McKenzie
8,403,303 B2 3/2013 Payne et al.
8,899,555 B2 12/2014 Sherstad
9,027,909 B1 5/2015 Peyton
9,435,134 B2 9/2016 Walmsley
9,482,028 B2 * 11/2016 Springborn ..... E04H 17/1447
9,784,011 B2 * 10/2017 Walker ..... E04H 17/1439
9,797,158 B2 * 10/2017 Springborn ..... E04H 15/62
2002/0000454 A1 1/2002 Pettit et al.
2002/0023406 A1 2/2002 Pettit et al.
2002/0056251 A1 5/2002 Venegas, Jr.
2002/0109132 A1 8/2002 Tsao
2003/0196395 A1 10/2003 Forbis et al.
2004/0009338 A1 1/2004 Jo et al.
2004/0018666 A1 1/2004 Lee et al.
2004/0026679 A1 2/2004 Terrels et al.
2004/0051092 A1 3/2004 Curatolo
2004/0188666 A1 9/2004 Pratt
2005/0075423 A1 4/2005 Riebel et al.
2005/0199866 A1 9/2005 Green
2005/0242336 A1 11/2005 Giacchino
2006/0001015 A1 1/2006 Forbis et al.
2006/0202186 A1 9/2006 Rowley et al.
2006/0273295 A1 12/2006 Maly et al.
2007/0062146 A1 3/2007 Van Dijk et al.
2007/0158630 A1 7/2007 Lo
2007/0170410 A1 7/2007 Devine
2007/0181865 A1 8/2007 Hein
2007/0181866 A1 8/2007 Strong
2008/0023684 A1 1/2008 Diamond et al.
2008/0217598 A1 9/2008 Dombroski
2008/0265232 A1 10/2008 Terrels et al.
2008/0299351 A1 12/2008 Buchholtz et al.
2009/0065755 A1 3/2009 Sherstad

(56) References Cited

U.S. PATENT DOCUMENTS

| | | | |
|---|---|---|---|
| 2009/0065756 | A1 | 3/2009 | McGinness et al. |
| 2009/0226246 | A1 | 9/2009 | Piper et al. |
| 2010/0155683 | A1 | 6/2010 | Payne et al. |
| 2010/0237308 | A1 | 9/2010 | Lo |
| 2011/0001104 | A1 | 1/2011 | Rowley et al. |
| 2011/0073824 | A1 | 3/2011 | Lappin et al. |
| 2011/0155982 | A1 | 6/2011 | Duffy et al. |
| 2012/0090140 | A1 | 4/2012 | Montemayor et al. |

FOREIGN PATENT DOCUMENTS

| | | | | |
|---|---|---|---|---|
| CA | 2298963 | A1 | 8/2001 | |
| CA | 2157155 | C | 11/2001 | |
| CA | 2349963 | A1 | 12/2001 | |
| CA | 2362250 | A1 | 5/2002 | |
| CA | 2340600 | A1 | 9/2002 | |
| CA | 2363976 | A1 | 5/2003 | |
| CA | 2624235 | A1 | 9/2009 | |
| CA | 2653263 | A1 | 9/2009 | |
| CA | 2683274 | A1 | 4/2010 | |
| DE | 1684649 | A1 | 12/1969 | |
| DE | 7707911 | U1 | 7/1977 | |
| EP | 0754600 | A1 | 1/1997 | |
| FR | 2814529 | A1 | 3/2002 | |
| JP | H09195476 | A | 7/1997 | |
| WO | 2007119039 | A1 | 10/2007 | |
| WO | 2008078116 | A1 | 7/2008 | |
| WO | WO-2018012986 | A1 * | 1/2018 | ..... E04H 17/168 |

OTHER PUBLICATIONS

Canadian Intellectual Property Office, Examiner's Requisition and Examination Search Report, Canadian Application No. 2,669,440 dated Jul. 3, 2015, 5 pages.

Canadian Intellectual Property Office, Examiner's Requisition and Examination Search Report, Canadian Application No. 2,683,274 dated Jun. 27, 2016, 3 pages.

Canadian Intellectual Property Office, Examiner's Requisition and Examination Search Report, Canadian Application No. 2,669,440 dated Jun. 27, 2016, 5 pages.

* cited by examiner

RAILING SYSTEM

CROSS-REFERENCE TO RELATED APPLICATIONS

This application claims priority under 35 U.S.C. § 119(e) from U.S. Provisional Patent Application No. 62/586,088 filed on Nov. 14, 2017, which is incorporated herein by reference in its entirety.

The present disclosure relates to a plastic railing system.

BACKGROUND OF THE DISCLOSURE

1. Field of the Disclosure

The present disclosure relates to a plastic railing system.

2. Description of the Related Art

Plastic railing systems are commonly used in commercial and residential buildings. Many different ways of making railing systems have been developed.

However, existing methods of assembling plastic railing systems require precise alignment of component parts, and use multiple fasteners.

SUMMARY OF THE DISCLOSURE

This disclosure provides a railing system that includes a positioning system which limits the movement of a baluster relative to a rail.

In some embodiments, for example, the positioning system includes a projection and a recess. When the railing system is constructed, the projection keys into the recess, such that the movement of the baluster relative to the rail is limited. The projection may be configured on the rail and the recess may be configured on the baluster, or vice versa. When the projection is configured on the rail, the projection may be a continuous piece, or the projection may comprise discrete projections of various lengths.

In one aspect, there is provided a kit for assembly of a railing system, comprising: an upper rail member; a lower rail member; and a plurality of posts for disposition relative to the upper and lower rail member such that the posts extend between the upper and lower rail members; wherein: the upper rail member and the plurality of posts are co-operatively configured for defining an upper rail member positioning system for effecting positioning of the posts relative to the upper rail member, wherein, for each one of the posts, independently, the effected positioning is such that a projection is disposed between a first opposing surface and a second opposing surface, wherein the first opposing surface opposes a first side of the projection and the second opposing surface opposes an opposite second side of the projection, with effect that lateral displacement of the post, relative to the upper rail member, is restricted; the lower rail member and the plurality of posts are co-operatively configured for defining a lower rail member positioning system for effecting positioning of the posts relative to the lower rail member, wherein, for each one of the posts, independently, the effected positioning is such that a projection is disposed between a first opposing surface and a second opposing surface, wherein the first opposing surface opposes a first side of the projection and the second opposing surface opposes an opposite second side of the projection, with effect that lateral displacement of the post, relative to the lower rail member, is restricted.

In another aspect, there is provided a kit for assembly of a railing system, comprising: an upper rail member; a lower rail member; and a plurality of posts for disposition relative to the upper and lower rail member such that the posts extend between the upper and lower rail members; wherein: the upper rail member and the plurality of posts are co-operatively configured for defining an upper rail member positioning system for effecting positioning of the posts relative to the upper rail member, wherein, for each one of the posts, independently, the effected positioning is such that a projection is disposed between a first opposing surface and a second opposing surface, wherein the first opposing surface opposes a first side of the projection and the second opposing surface opposes an opposite second side of the projection, with effect that rotation of the post, about its axis, is restricted; the lower rail member and the plurality of posts are co-operatively configured for defining a lower rail member positioning system for effecting positioning of the posts relative to the lower rail member, wherein, for each one of the posts, independently, the effected positioning is such that a projection is disposed between a first opposing surface and a second opposing surface, wherein the first opposing surface opposes a first side of the projection and the second opposing surface opposes an opposite second side of the projection, with effect that rotation of the post, about its axis, is restricted.

In another aspect, there is provided a railing system comprising: an upper rail; a lower rail; and a plurality of posts disposed between the upper and lower rails; wherein: the upper rail and the plurality of posts co-operate for defining an upper rail positioning system and a lower rail positioning system; the upper rail positioning system effects positioning of the posts relative to the upper rail such that, for each one of the posts, independently, a projection is disposed between a first opposing surface and a second opposing surface, wherein the first opposing surface opposes a first side of the projection and the second opposing surface opposes an opposite second side of the projection, with effect that lateral displacement of the post, relative to the upper rail, is restricted; and the lower rail positioning system effects positioning of the posts relative to the lower rail, such that, for each one of the posts, independently, a projection is disposed between a first opposing surface and a second opposing surface, wherein the first opposing surface opposes a first side of the projection and the second opposing surface opposes an opposite second side of the projection, with effect that lateral displacement of the post, relative to the upper rail, is restricted.

In another aspect, there is provided a railing system comprising: an upper rail; a lower rail; and a plurality of posts disposed between the upper and lower rails; wherein: the upper rail and the plurality of posts co-operate for defining an upper rail positioning system and a lower rail positioning system; the upper rail positioning system effects positioning of the posts relative to the upper rail such that, for each one of the posts, independently, a projection is disposed between a first opposing surface and a second opposing surface, wherein the first opposing surface opposes a first side of the projection and the second opposing surface opposes an opposite second side of the projection, with effect that rotation of the post, about its axis, is restricted; and the lower rail positioning system effects positioning of the posts relative to the lower rail, such that, for each one of the posts, independently, a projection is disposed between a first opposing surface and a second opposing surface, wherein the first opposing surface opposes a first side of the projection and the second opposing surface opposes an opposite second side of the projection, with effect that rotation of the post, about its axis, is restricted.

In another aspect, there is provided a kit for assembly of a railing system, comprising: an upper rail member; a lower rail member; an upper continuous projection extending from the upper rail member; a lower continuous projection extending from the lower rail member; and a plurality of posts for disposition between the upper and lower rail members; wherein: for each one of the posts, independently, the post is configured to receive the upper continuous projection with effect that lateral displacement of the post, relative to the upper rail member, is restricted, and is also configured to receive the lower continuous projection with effect that lateral displacement of the post, relative to the lower rail member, is restricted.

In another aspect, there is provided a kit for assembly of a railing system, comprising: an upper rail member; a lower rail member; an upper continuous projection extending from the upper rail member; a lower continuous projection extending from the lower rail member; and a plurality of posts for disposition between the upper and lower rail members; wherein: for each one of the posts, independently, the post is configured to receive the upper continuous projection with effect that rotation of the post, about its axis, is restricted, and is also configured to receive the lower continuous projection with effect that rotation of the post, about its axis, is restricted.

In another aspect, there is provided a railing system comprising: an upper rail member; a lower rail member; an upper continuous projection extending from the upper rail member; a lower continuous projection extending from the lower rail member; and a plurality of posts disposed between the upper and lower rail members; wherein: for each one of the posts, independently, the upper continuous projection is received by the post with effect that lateral displacement of the post, relative to the upper rail member, is restricted, and also the lower continuous projection is received by the post with effect that lateral displacement of the post, relative to the lower rail member, is restricted.

In another aspect, there is provided a railing system comprising: an upper rail member; a lower rail member; an upper continuous projection extending from the upper rail member; a lower continuous projection extending from the lower rail member; and a plurality of posts disposed between the upper and lower rail members; wherein: for each one of the posts, independently, the upper continuous projection is received by the post with effect that lateral displacement of the post, relative to the upper rail member, is restricted, and also the lower continuous projection is received by the post with effect that rotation of the post, about its axis, is restricted.

In another aspect, there is provided a kit for assembly of a railing system, comprising: a first rail member; a plurality of posts; a first positioning system defined by at least one projection, wherein each one of the at least one projection of the first positioning system extends from the first rail member; wherein: the posts are configured to interact with the first positioning system with effect that the first positioning system restricts lateral displacement of the posts relative to the first rail member.

In another aspect, there is provided a kit for assembly of a railing system, comprising: a first rail member; a plurality of posts; a first positioning system defined by at least one projection, wherein each one of the at least one projection of the first positioning system extends from the rail member; wherein: the posts are configured to interact with the first positioning system with effect that the first positioning system restricts rotation of the posts about their axes.

In another aspect, there is provided a railing system comprising: a first rail member; a first positioning system defined by at least one projection, wherein each one of the at least one projection of the first positioning system extends from the first rail member; a second rail member; a second positioning system defined by at least one projection, wherein each one of the at least one projection of the second positioning system extends from the second rail member; and a plurality of posts disposed between the upper and lower rail members; wherein: wherein: each one of the posts includes a first end, and a first recess is defined at the first end; the posts interact with the first positioning system with effect that the first positioning system restricts lateral displacement of the post relative to the first rail member; the interaction between the posts and the first positioning system includes the receiving of the at least one projection of the first positioning system by the first recesses of the posts; each one of the posts includes a second end, and a second recess is defined at the second end; the posts interact with the second positioning system with effect that the second positioning system restricts lateral displacement of the post relative to the second rail member; and the interaction between the posts and the second positioning system includes the receiving of the at least one projection of the second positioning system by the second recesses of the posts.

BRIEF DESCRIPTION OF THE DRAWINGS

Reference will now be made, by way of example, to the accompanying drawings which show example embodiments of the present application, and in which.

DETAILED DESCRIPTION OF THE DISCLOSURE

In various examples, the present disclosure describes a railing system 10 including a positioning system for limiting movement between a rail and a baluster. Although the present disclosure provides examples, the disclosed methods and devices may be suitable for other purposes, with modification as appropriate.

Figure 1:
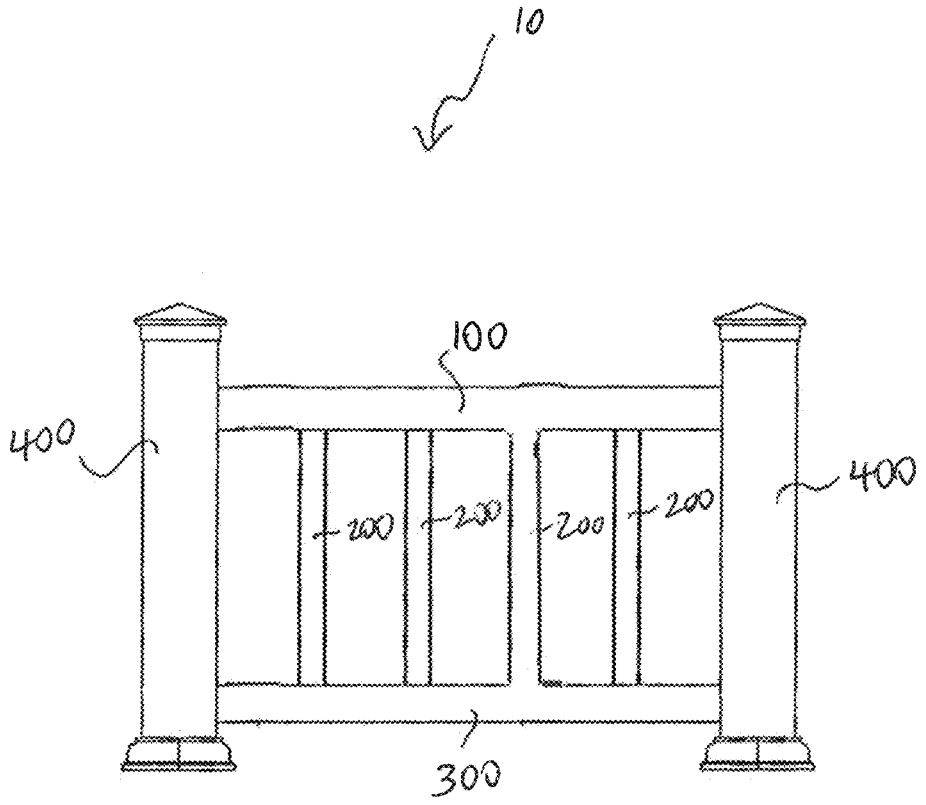
FIG. 1 is a front elevation view of an embodiment of a railing system.
Figure 2:
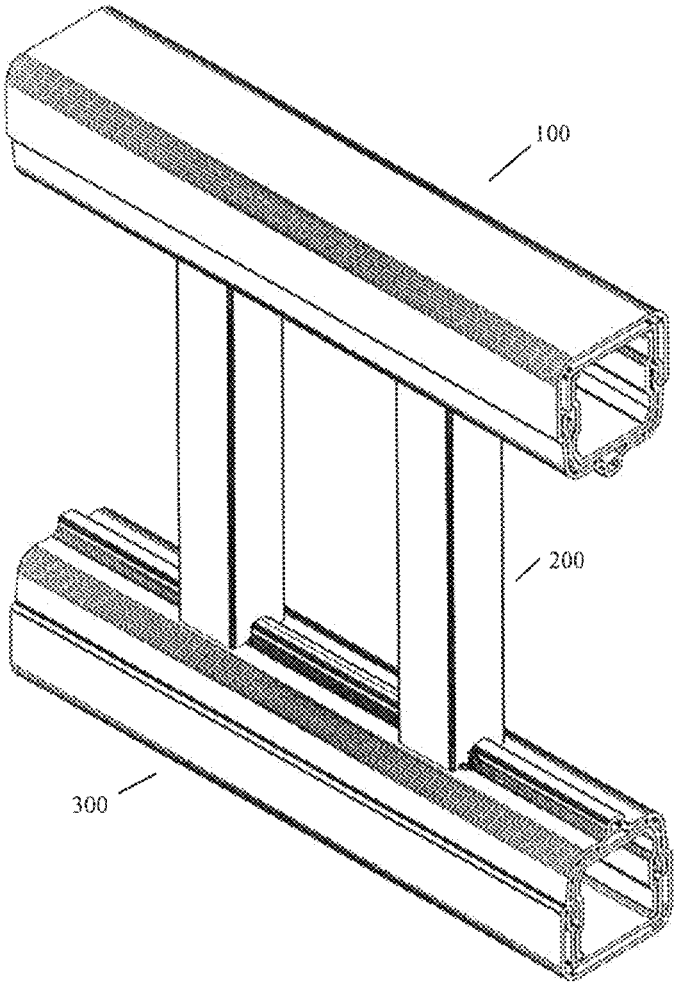
FIG. 2 is a perspective view of a section of the railing system illustrated in FIG. 1.

FIGS. 1 and 2 illustrate an exemplary railing system 10. The railing system 10 includes an upper horizontal rail 100, a lower horizontal rail 300, and a plurality of spaced-apart balusters 200. The rail 100 is vertically spaced-apart relative to the lower rail 300. In the embodiment illustrated in FIG. 1, each one of the rails 100, 300, independently, is connected at both ends to a newel post 400.

The balusters are disposed between the rails 100, 200. In some embodiments, for example, the balusters extends from the rail 100 to the rail 200. Although two balusters 200 are shown disposed between the upper and lower horizontal rails 100, 300, it is understood that more balusters may be connected to and disposed between the upper and the lower rails 100, 300. In some embodiments, for example, the number of balusters is at least four (4), such as, for example, at least six (6), such as, for example, at least eight (8), such as, for example, at least ten (10). In some embodiments, for example, the spacing distance between the balusters 200 is the same or substantially the same. In some embodiments, for example, the balusters 200 are spaced apart by varied distances between them. In some embodiments, the balusters 200 extend vertically, or substantially vertically, between the rails 100 and 300.

In some embodiments, for example, each one of the rails 100, 200, independently, is generally elongated. In some embodiments, for example, each one of the rails 100, 200 includes a respective central longitudinal axis.

Figure 3:
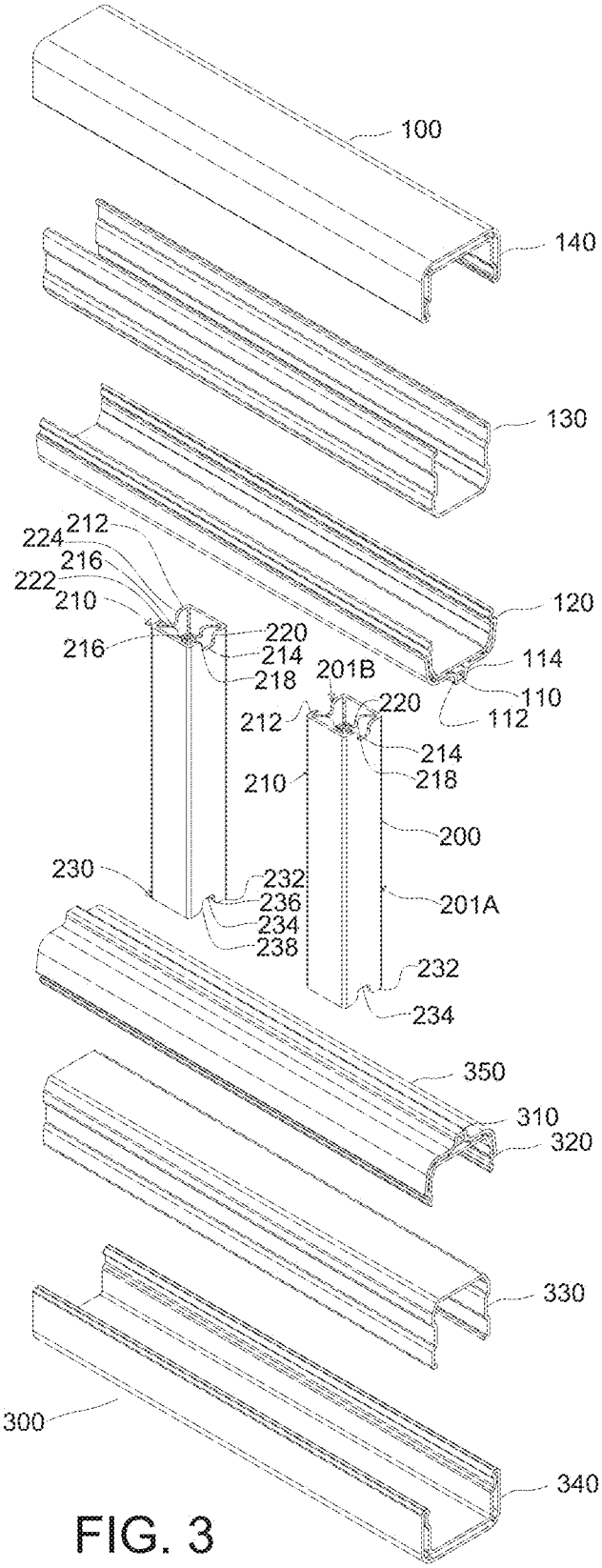
FIG. 3 is an exploded perspective view of the section illustrated in FIG. 2.

Referring to FIG. 3, in some embodiments, for example, the upper rail 100 includes a first rail member 120 and a second rail member 140. The first and second rail members 120, 140 are configured for coupling to one another to conceal a cavity. This may prevent foreign matter from entering the cavity, for example, dust, and water, to prevent premature degradation of the rail. This may also serve to provide a more aesthetically appealing rail.

In some embodiments, each one of the rail members 120, 140, independently, is made of plastic, such as high density polyethylene, polypropylene, polycarbonate, acrylonitrile butadiene styrene (ABS). In some embodiments, each one of the balusters, independently, is made of polyvinyl chloride. In some embodiments, each one of the rail members 120, 140, independently, is manufactured with an extrusion process to form a unitary one-piece construction. In some embodiments, for example, each one of the rail members 120, 140, independently, is an extruded plastic lineal. In some embodiments, for example, each one of the first rail member 120 and the second rail member 140, independently, is double-walled for increasing rigidity.

Figure 4:
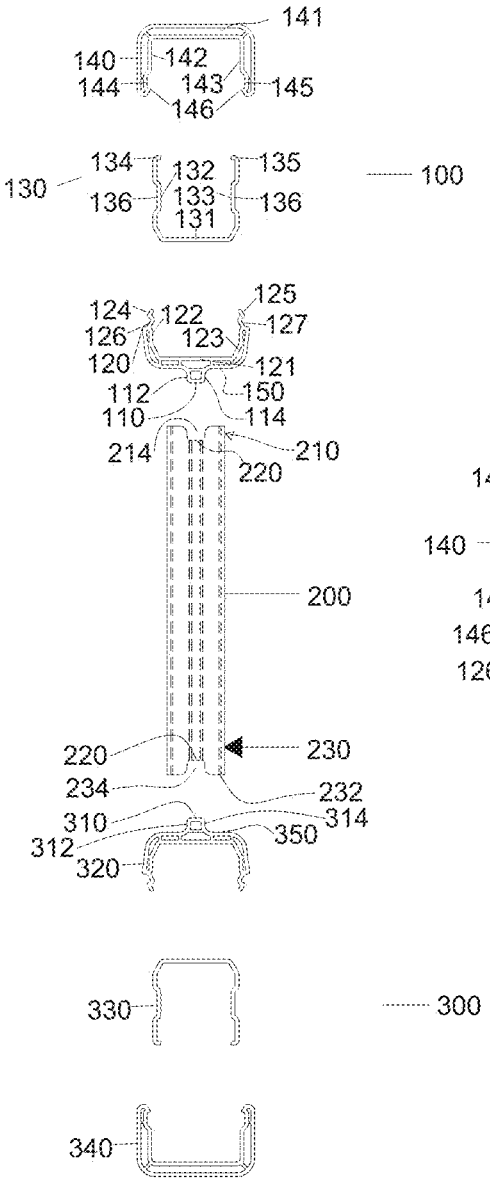
FIG. 4 is an exploded view, in cross-section, of the section illustrated in FIG. 2.
Figure 5:
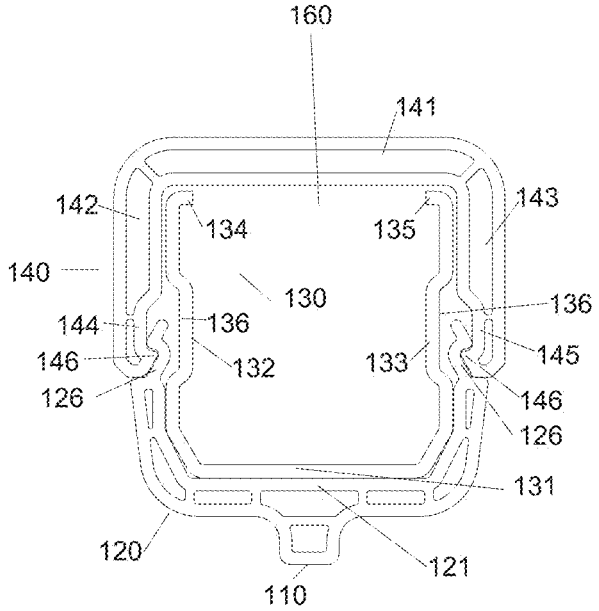
FIG. 5 is a sectional side elevation view of the upper rail of the railing system illustrated FIG. 1.

Referring to FIGS. 4 and 5, in some embodiments, for example, the first rail member 120 has a horizontal wall 121 and first and second sidewalls 122, 123, respectively, extending upwardly from the horizontal wall 121, and extending along the length of the horizontal wall 121. The first sidewall 122 includes a free end 124 and the second sidewall includes a free end 125. Each one of the free ends 124, 125, independently, is formed with a channel 126 and a protrusion 127. The second rail member 140 includes a horizontal wall 141, and first and second sidewalls 142, 143, extending downwardly from the horizontal wall 141, and extending along the length of the horizontal wall 141. The first sidewall 142 includes a free end 144 and the second sidewall 143 includes a free end 145. Each one of the free ends 144, 145, independently, is formed with a protrusion 146. The protrusions 146 engages the channels 126, for example, by snap fit engagement, to couple the first rail member 120 to the second rail member 140. In some embodiments, after the rail member 140 and the rail member 120 are coupled, the wall 141 is parallel, or substantially parallel, to the wall 121.

In some embodiments, for example, an insert 130 is disposed within the cavity 160, and extends lengthwise of the first and second rail members 120, 140, for reinforcing the first and second rail members 120, 140. In some embodiments, for example, the insert 130 is made of any one of metal, plastic, or composite material. In some embodiments, the insert is made of metal. In some embodiments, for example, the insert 130 is made of steel or aluminum.

In some embodiments, for example, the insert 130 has a channel-shaped interior. The insert 130 includes a horizontal wall 131, a first sidewall 132, and a second sidewall 133. Each one of the sidewalls 132, 133, independently, has a recess 136 in the middle section for receiving the free ends 124 and 125 of the first rail member 120, for effecting coupling of the insert 130 to the rail member 120 (and, therefore, the rail 100) in an interference fit relationship. The sidewalls 132, 133 extend beyond the sidewalls 122, 123. The free ends 134, 135 of the sidewalls 132, 133, respectively, extend toward the channel. In some embodiments, an interference fit relationship is formed between the interior surfaces of the walls 142, 143 and the exterior surfaces of the upper portions of the sidewalls 132, 133, such that the reinforcing insert 130 structurally reinforces the sides of the second rail member 140. In some embodiments, an interference fit relationship is formed between the interior surfaces of the walls 122, 123 and the exterior surfaces of the lower portions of the walls 132, 133, such that the reinforcing insert 130 structurally reinforces the rail piece 120. In some embodiments, an interference fit relationship is formed between the interior surface of the wall 141 and the exterior surfaces of the free ends 134, 135 such that the reinforcing insert 130 structurally reinforces the top of the rail member 140. In some embodiments, an interference fit relationship is formed between the exterior surface of the wall 131 and the interior surface of the wall 121 such that the reinforcing insert 130 reinforces the bottom side of the first rail member 120. An example of the rail members 120, 140 engaging the insert 130 is illustrated in FIG. 5.

In some embodiments, for example, the construction of the lower horizontal rail 300 is identical, or substantially identical, to the construction of the upper horizontal rail 100, and, in this respect, includes corresponding first and second rail members 320, 340 and insert 330 (see FIGS. 3 and 4). In some embodiments, for example, the lower rail 300 is configured differently from the upper rail 100.

The balusters 200 are configured for coupling to the rail 100, and also configured for coupling to the rail 300. In some embodiments, each one of the balusters, independently, is made of plastic, such as high density polyethylene, polypropylene, polycarbonate, acrylonitrile butadiene styrene (ABS). In some embodiments, each one of the balusters, independently, is made of polyvinyl chloride. In some embodiments, each one of the balusters, independently, is preferably manufactured with an extrusion process to form a unitary one-piece construction. In some embodiments, for example, each one of the balusters 200, independently, is an extruded plastic lineal.

For effecting the coupling of the balusters 200 to the rails 100, 300, each one of the rails 100, 300, independently, defines a respective positioning system. In some embodiments, for example, for each one of the rails 100, 300, the positioning system is defined by an elongated projection 110 (310) that extends from the respective rail 100 (300) and is receivable by the balusters 200. In some of these embodiments, for example, the projection 110 (or 310) is continuous and uninterrupted. In other embodiments, for example, the positioning system is defined by a plurality of discrete projections that extend from the respective rail 100 (300) and is receivable by the ballusters.

The first rail member 120 of the upper rail 100 includes an inwardly facing surface 150, and the projection 110 extends from the surface 150. In some embodiments, for example, the surface 150 is planar or substantially planar. In some embodiments, for example, the projection 110 extends longitudinally such that a longitudinal axis of the projection is parallel, or substantially parallel, to the central longitudinal axis of the first rail member 120. In some embodiments, for example, the projection 110 has a height of at least about 1/16 inches. In some embodiments, for example, the projection 110 has a height of between about 1/16 inches and about 2 inches. In some embodiments, for example, the projection 110 has a width of at least about 1/8 inches. In some embodiments, for example, the projection 110 has a width of between about 1/8 inches and about 1/4 inches. In some embodiments, for example, the projection 110 has a length of at least about 12 inches. In some embodiments, for example, the projection 110 has a length of between about 12 inches and about 84 inches.

The first rail member 320 of the lower rail 300 includes an inwardly facing surface 350, and the projection 310 extends from the surface 350. In some embodiments, for example, the surface 350 is planar or substantially planar. In some embodiments, for example, the projection 310 is uninterrupted and continuous, and extends longitudinally such that a longitudinal axis of the projection is parallel, or substantially parallel, to the central longitudinal axis of the first rail member 320. In some embodiments, for example, the projection 310 has a height of at least about 1/16 inches. In some embodiments, for example, the projection 310 has a height of between about 1/16 inches and about 2 inches. In some embodiments, for example, the projection 310 has a width of at least about 1/8 inches. In some embodiments, for example, the projection 310 has a width of between about 1/8 inches and about 1/4 inches. In some embodiments, for example, the projection 310 has a length of at least about 12 inches. In some embodiments, for example, the projection 310 has a length of between about 12 inches and about 84 inches.

In some embodiments, for example the projections 110, 310 are identical, or substantially identical. In some embodiments, for example, the projection 110 is of a different configuration relative to the projection 310.

Each one of the balusters 200, independently, is configured for receiving the projections 110, 310. In some embodiments, for example, the upper rail 100, the lower rail 300, and the balusters 200 are co-operatively configured such that, for each one of the balusters 200, the baluster 200 is configured to simultaneously receive both of the projections 110, 310. In this respect, in some embodiments, for example, each one of the balusters 200, independently, defines a space at its upper end 210 for receiving the upper projection 110, and also defines a space at its lower end 230 for receiving the lower projection 310.

In some embodiments, for example, for each one of the balusters 200, independently, the baluster 200 is configured to receive the projection 110 with effect that lateral displacement of the baluster 200, relative to the upper rail member 100, is restricted, and is also configured to receive the projection 310 with effect that lateral displacement of the baluster 200, relative to the lower rail member 300, is restricted. In some of these embodiments, for example, the lateral displacement is prevented or substantially prevented.

In some embodiments, for example, for each one of the balusters 200, independently, the baluster 200 is configured to receive the projection 110 with effect that rotation of the baluster 200 about its central longitudinal axis is restricted, and is also configured to receive the projection 310 with effect that rotation of the baluster 200 about its central longitudinal axis is restricted. In some embodiments, for example, the rotation is prevented or substantially prevented.

Figure 3A:
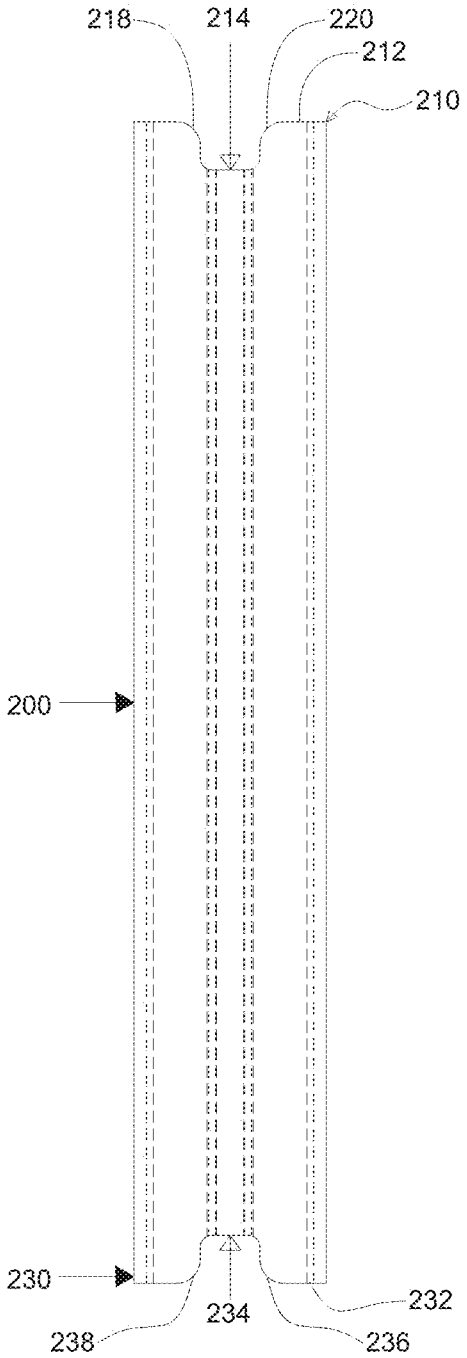
FIG. 3A is a side elevation view of a first side of a baluster of the railing system illustrated in FIG. 1.
Figure 3B:
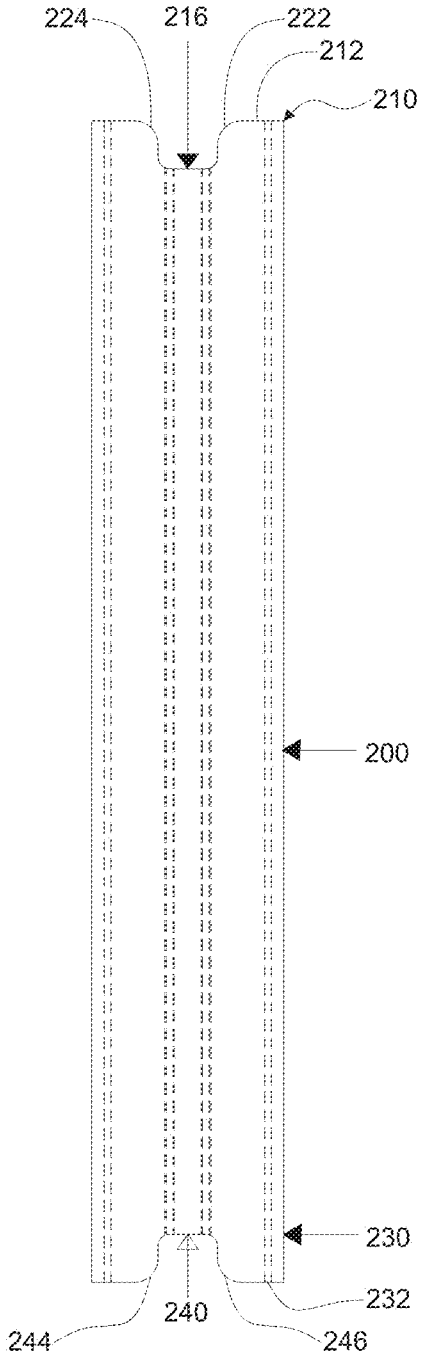
FIG. 3B is a side elevation view of a second side of a baluster of the railing system illustrated in FIG. 1, opposite to the first side that is illustrated in FIG. 3A.

Referring to FIGS. 3, 3A, and 3B, in some embodiments, for example, the space defined at the upper end 210 of the baluster 200 includes a first upper slot 214, defined in the baluster 200, and recessed from an upper edge 212 of the upper end 210 of the baluster 200, a second upper slot 216, defined in the baluster, and recessed from the upper edge 212 of the upper end 210 of the baluster 210, and an upper passage 218, defined by a cavity within the baluster 200. The first upper slot 214 is disposed in alignment with the second upper slot 216 and on a first side 201A of the baluster 200 that is opposite to the second side 201B of the baluster 200 within which the second upper slot 216 is defined. The first upper slot 214, the second upper slot 216, and the upper passage 218 are co-operatively configured such that the space extends from the first upper slot 214 to the second upper slot 216 via the upper passage 218, such that the upper projection 110 of the upper rail member 100 is receivable through, and extendable between, the first and second upper slots 214, 216. The first upper slot 214 is defined by a respective slot-defining surface of the baluster, and the slot-defining surface include surface portions 218, 220 that oppose opposite side surfaces 112, 114, respectively, of the projection 110. In some of these embodiments, such configuration thereby limits (and, in some embodiments, for example, opposes) lateral displacement between the rail member 120 and the baluster 200. In some of these embodiments, such configuration thereby limits rotation of the baluster 200 about its central longitudinal axis. The second upper slot 216 is defined by a respective slot-defining surface of the baluster, and the slot-defining surface include surface portions 222, 224 that oppose opposite side surfaces 112, 114, respectively, of the projection 110. In some of these embodiments, for example, such configuration thereby limits (and, in some embodiments, for example, opposes) lateral displacement between the rail member 120 and the baluster 200. In some of these embodiments, such configuration thereby limits rotation of the baluster 200 about its central longitudinal axis. In this respect, when the upper projection 110 is received through the first and second upper slots of the baluster 200, such that the upper projection 100 extends through the first and second upper slots, lateral displacement of the baluster 200, relative to the central longitudinal axis of the rail member 110 (and, when suitably assembled, the upper rail 100) is restricted. Also in this respect, when the upper projection 110 is received through the first and second upper slots of the baluster 200, such that the upper projection 100 extends through the first and second upper slots, rotation of the baluster 200 about its central longitudinal axis (and, when suitably assembled, the upper rail 100) is restricted.

Again referring to FIGS. 3, 3A, and 3B, in some embodiments, for example, the space defined at the lower end 230 of the baluster 200 is similarly configured to the space defined at the upper end 210 of the baluster 200, and includes a first lower slot 234, defined in the baluster 200, and recessed from a lower edge 232 of the lower end 230 of the baluster 200, a second lower slot 240, defined in the baluster 200, and recessed from the lower edge 232 of the lower end 230 of the baluster 200, and a lower passage 242, defined by a cavity within the baluster 200. The first lower slot 234 is disposed in alignment with the second lower slot 240 and on a first side 201A of the baluster 200 that is opposite to the second side 2016 of the baluster 200 within which the second lower slot 240 is defined. The first lower slot 234, the second lower slot 240, and the lower passage 242 are co-operatively configured such that the space extends from the first lower slot 234 to the second lower slot 240 via the lower passage 242, such that the lower projection 310 of the lower rail member 300 is receivable through, and extendable between, the first and second lower slots 234, 240. The first lower slot 234 is defined by a respective slot-defining surface of the baluster, and the slot-defining surface include surface portions 236, 238 that oppose opposite side surfaces 312, 314, respectively, of the projection 310, and thereby limit (and, in some embodiments, for example, oppose) lateral displacement between the rail member 320 and the baluster 200. The second lower slot 240 is defined by a respective slot-defining surface of the baluster, and the slot-defining surface include surface portions 244, 246 that oppose opposite side surfaces 312, 314, respectively, of the projection 310. In some of these embodiments, such configuration thereby limits (and, in some embodiments, for example, opposes) lateral displacement between the rail member 320 and the baluster 200. In some of these embodiments, such configuration thereby limits rotation of the baluster 200 about its central longitudinal axis. In this respect, when the lower projection 310 is received through the first and second lower slots of the baluster 200, such that the lower projection 310 extends through the first and second lower slots 234, 236, lateral displacement of the baluster 200, relative to the central longitudinal axis of the rail member 320 (and, when suitably assembled, the lower rail 300) is restricted. Also in this respect, when the lower projection 310 is received through the first and second lower slots of the baluster 200, such that the lower projection 310 extends through the first and second lower slots 234, 236, rotation of the baluster 200 relative to its central longitudinal axis (and, when suitably assembled, the lower rail 300) is restricted.

In some embodiments, for example, when the balusters 200 receive the the projections 110, for each one of the balusters 200, the upper end 210 of the baluster is disposed in contact engagement with the inwardly facing surface 150 of the rail member 120. Similarly, in some embodiments, for example, when the balusters 200 receive the projections 310, for each one of the balusters, independently, the lower end 230 of the baluster is disposed in contact engagement with the inwardly facing surface 350 of the rail member 320.

In some embodiments, for example, for each one of the balusters 200, independently, while: (i) the projection 110 is received by the baluster, and (ii) the projection 310 is received by the baluster 200, vertical displacement of the baluster 200, relative to the upper rail member 120, is restricted (and, in some embodiments, for example, opposed) by the upper rail member 120, and vertical displacement of the baluster 200, relative to the lower rail member 320, is limited (and, in some embodiments, for example, opposed) by the lower rail member 320.

In some embodiments, for example, for each one of the balusters 200, independently, while: (i) the projection 110 is received by the baluster, and (ii) the projection 310 is received by the baluster, the inwardly facing surface of the upper first rail member 120 is opposing the inwardly facing surface of lower first rail member 320.

Figure 6:
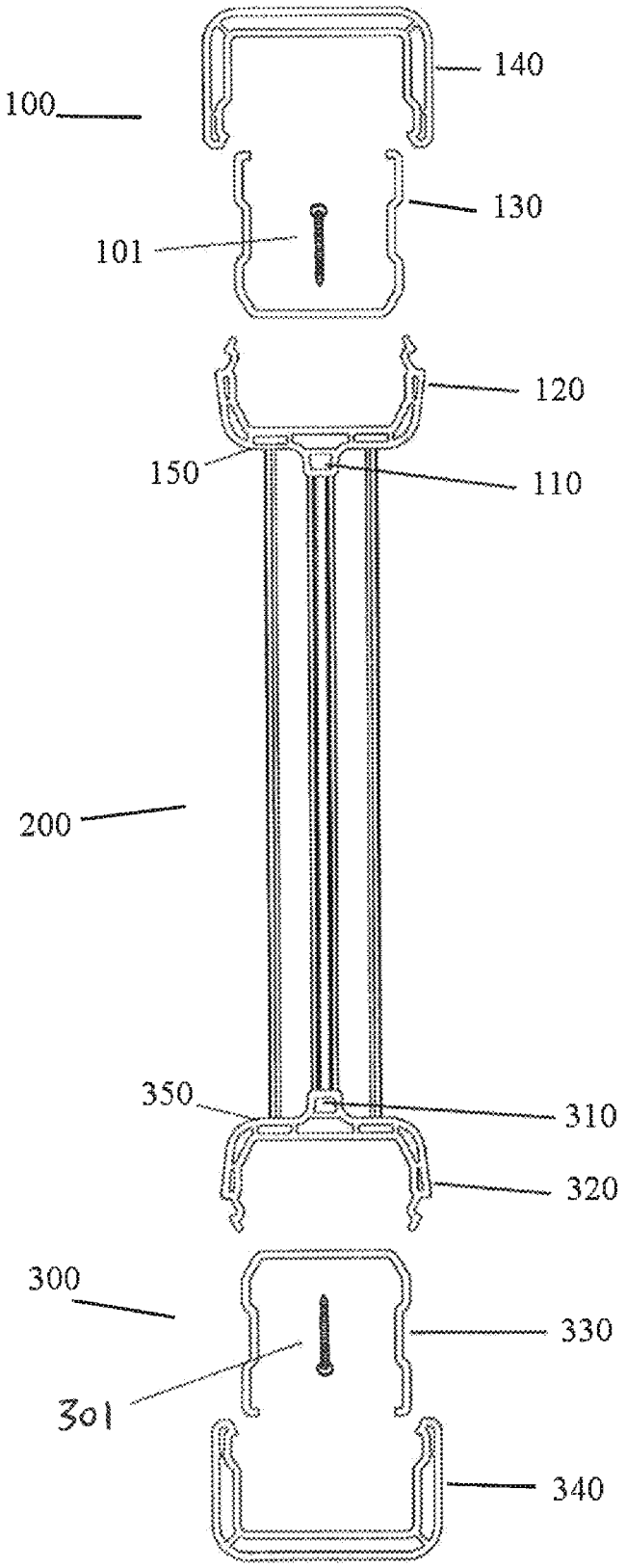
FIG. 6 is another exploded view, in cross-section, of the section illustrated in FIG. 1, in which the rails and balusters are connected.
Figure 7:
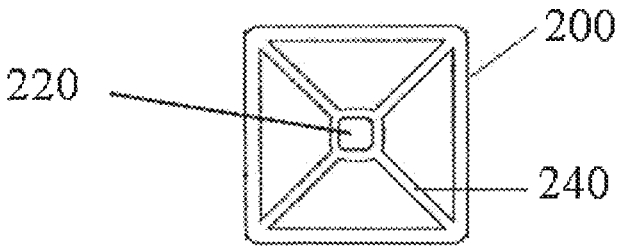
FIG. 7 is a top view of the baluster.

Referring to FIGS. 6 and 7, in some embodiments, for example, each one of the balusters 200, independently, is configured for receiving a fastener 101, such that, for each one of the balusters, independently, securing of the baluster 200 to the rail 100 is effected. In some embodiments, for example, each one of the balusters 200, independently, is configured for receiving a fastener 301, such that, for each one of the balusters, independently, securing of the baluster 200 to the rail 300 is effected. Referring to FIG. 7, a receptacle 220 is defined at, or substantially at, the center of an upper end of the baluster 200 for anchoring the fastener 101, and a receptacle 221 is defined at, or substantially at, the centre of the lower end of the baluster 200 for anchoring the fastener 301. Each one of the rails 100, 300 includes respective spaced apart apertures for registration with the receptacles 220, 221 of the balusters 200. In some embodiments, a fastener is inserted through a corresponding aperture defined in the first rail member 120 and is threadedly received in the receptacle 220 such that the head of the fastener bears against the upper first rail member 120, drawing the baluster 200 and the upper first rail member 120 securely together, and a fastener is inserted through a corresponding aperture defined in the lower first rail member 320 and is threadedly received in the receptacle 221 such that the head of the fastener bears against the lower first rail member 320, drawing the baluster 200 and the lower first rail member 320 securely together. In some embodiments, for example, the fastener is a screw. In some embodiments, for example, enhancing ribs 240 are provided for effecting connection of the receptacle 220 to the corners of the baluster 200.

As shown in FIG. 6, in some embodiments, a single fastener is sufficient to fix the rail 100 to the baluster 200, and a single fastener is sufficient to fix the rail 300 to the baluster 200, and this is because the positioning system limits lateral movement of the baluster and the rails. Without the positioning system, the baluster may rotate about the single fastener.

Figure 8:
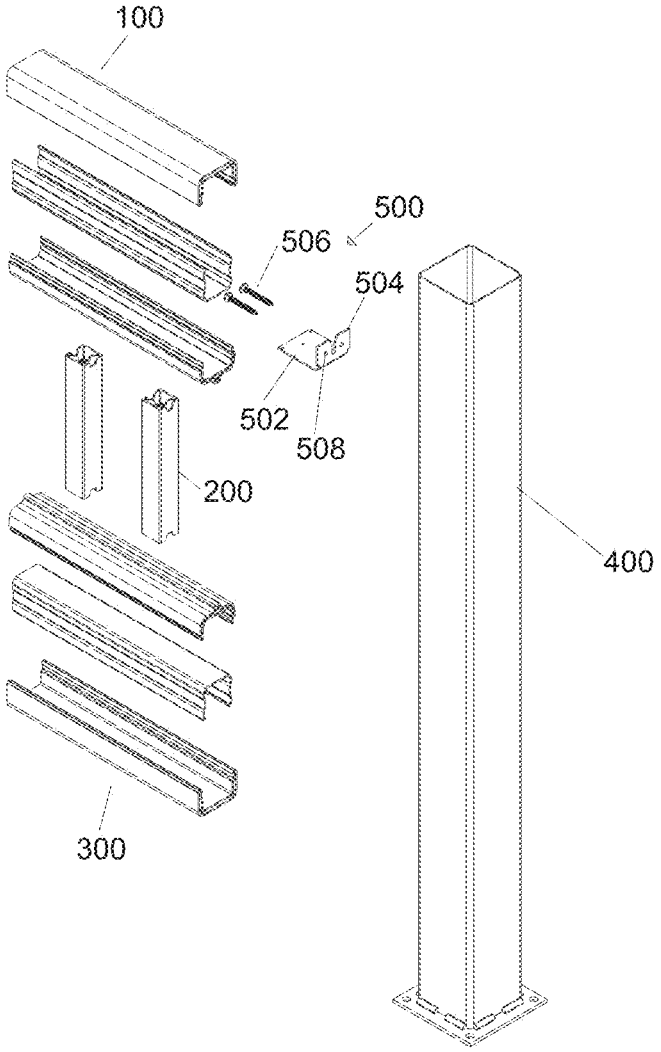
FIG. 8 is an exploded perspective view of the section illustrated in FIG. 2, disposed for connection to a newel post.

Referring to FIG. 8, in some embodiments, for example, the railing system further includes a mounting bracket 500 for securing one or both of the upper and lower rails 100, 200 to an upright 400, such as, for example, a wall, a column, or a newel post. In some embodiments, for example, a mounting bracket may be used at both ends of the rails 100, 200 to effect the desired securing. In some embodiments, for example, the mounting bracket 500 is made of metal, such as, for example, galvanized steel.

In the illustrated embodiment of FIG. 8, only one mounting bracket 500 is shown for effecting securement of one end of the upper rail 100 to the newel post 400, but it is understood that the second end of the upper rail 100 is also securable in like manner to another upright, and, similarly it is understood that one or both ends of the lower rail 300 is also securable in like manner to a respective upright, including the newel post 400.

The securement of one end of the upper rail 100 to the newel post 400, via the mounting bracket 500, will now be described. The mounting bracket 500 includes a generally planar first flange 502 oriented for being slidably received within corresponding channels defined within the upper rail 100. In some embodiments, for example, the upper rail 100 and the flange 502 are co-operatively configured such that the flange 502 is securable to the upper rail 100 with a fastener (such as, for example, a screw). The mounting bracket 500 further includes a generally planar second flange 504, joined to the first flange 502 and oriented vertically for securing the mounting bracket 500 to the newel post 400 via fasteners 506 (for example, screws) extending through apertures 508 defined within the second flange 504.

In some embodiments, for example, to assemble the railing system, each one of the balusters 200 is emplaced over a corresponding location on the projection 110 (or 310) of one of the upper first rail member 120 and the lower rail members 320 and fastened to the rail member 120 (or 320), to obtain an intermediate assembly. The projection 310 (or 110) of the other one of the rail members 320 (or 120) is then emplaced into the other end of the balusters 200 and fastened to balusters. Assembly of the rails 100, 200 is then completed, and this includes coupling the upper second rail member 140 to the upper first rail member 120 by way of snap fit engagement, and coupling the lower second rail member 340 to the lower first rail member 320 by way of snap fit engagement The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A kit for assembly of a railing system, comprising:
an upper rail member that defines an upper rail cavity;
a lower rail member that defines a lower rail cavity;
an upper continuous projection extending from the upper rail member, the upper continuous projection disposed outside the upper rail cavity;
a lower continuous projection extending from the lower rail member, the lower continuous projection disposed outside the lower rail cavity; and
a plurality of posts for disposition between the upper and lower rail members;
wherein for each one of the posts, the post is configured to independently receive the upper continuous projection so that lateral displacement of the post, relative to the upper rail member, is restricted, and also the lower continuous projection so that lateral displacement of the post, relative to the lower rail member, is restricted.

2. The kit as claimed in claim 1, wherein the upper continuous projection has a width of at least about ⅛ inch.

3. The kit as claimed in claim 1, wherein the upper continuous projection has a height of at least about 1/16 inch and the lower continuous projection has a height of at least about 1/16 inch.

4. The kit as claimed in claim 1, wherein the upper continuous projection has a length of at least about 12 inches, and the lower projection has a length of at least about 12 inches.

5. The kit as claimed in claim 1, wherein the upper continuous projection includes a longitudinal axis that is parallel, or substantially parallel, to the central longitudinal axis of the upper rail member, and wherein the lower continuous projection includes a longitudinal axis that is parallel, or substantially parallel, to the central longitudinal axis of the lower rail member.

6. The kit as claimed in claim 1,
wherein the upper continuous projection extends from an inwardly facing surface of the upper rail member and the lower continuous projection extends from an inwardly facing surface of the lower rail member, and
wherein the upper rail member, the lower rail member, and the plurality of posts are co-operatively configured so that, while: (i) the upper continuous projection is received by the post, and (ii) the lower continuous projection is received by the post, the inwardly facing surface of the upper rail member is opposing the inwardly facing surface of the lower rail member.

7. The kit as claimed in claim 1, wherein for each one of the posts, independently, the post defines a recess, for receiving the upper continuous projection, at the upper end of the post, and wherein for each one of the posts, independently, the post defines a recess, for receiving the lower continuous projection, at the lower end of the post.

8. A kit for assembly of a railing system, comprising:
an upper rail member that defines an upper rail cavity;
a lower rail member that defines a lower rail cavity;
an upper continuous projection extending from the upper rail member, the upper continuous projection disposed outside the upper rail cavity;
a lower continuous projection extending from the lower rail member, the lower continuous projection disposed outside the lower rail cavity; and
a plurality of posts for disposition between the upper and lower rail members;
wherein for each one of the posts, the post is configured to independently receive the upper continuous projection so that rotation of the post, about its axis, is restricted, and also the lower continuous projection so that rotation of the post, about its axis, is restricted.

9. The kit as claimed in claim 8, wherein the upper continuous projection has a width of at least about ⅛ inch.

10. The kit as claimed in claim 8, wherein the upper continuous projection has a height of at least about 1/16 inch, and the lower continuous projection has a height of at least about 1/16 inch.

11. The kit as claimed in claim 8, wherein the upper continuous projection has a length of at least about 12 inches, and the lower projection has a length of at least about 12 inches.

12. The kit as claimed in claim 8, wherein the upper continuous projection includes a longitudinal axis that is parallel, or substantially parallel, to the central longitudinal axis of the upper rail member, and wherein the lower continuous projection includes a longitudinal axis that is parallel, or substantially parallel, to the central longitudinal axis of the lower rail member.

13. The kit as claimed in claim 8, wherein the upper continuous projection extends from an inwardly facing surface of the upper rail member and the lower continuous projection extends from an inwardly facing surface of the lower rail member, and wherein the upper rail member, the lower rail member, and the plurality of posts are co-operatively configured so that, while: (i) the upper continuous projection is received by the post, and (ii) the lower continuous projection is received by the post, the inwardly facing surface of the upper rail member is opposing the inwardly facing surface of the lower rail member.

14. The kit as claimed in claim 8, wherein for each one of the posts, independently, the post defines a recess, for receiving the upper continuous projection, at the upper end of the post, and wherein for each one of the posts, independently, the post defines a recess, for receiving the lower continuous projection, at the lower end of the post.

* * * * *